US005819224A

United States Patent [19]

Xydeas

[11] Patent Number: 5,819,224

[45] Date of Patent: Oct. 6, 1998

[54] SPLIT MATRIX QUANTIZATION

[75] Inventor: Costas Xydeas, Wilmslow, United Kingdom

[73] Assignee: The Victoria University of Manchester, Manchester, England

[21] Appl. No.: 625,886

[22] Filed: Apr. 1, 1996

[51] Int. Cl.[6] ..... G10L 5/02

[52] U.S. Cl. ..... 704/266; 704/222; 704/262

[58] Field of Search ..... 395/2.75, 2.73, 395/2.28, 2.32, 2.16; 704/266, 264, 267, 268, 219, 223, 207, 262, 263, 265, 200, 222, 230

[56] References Cited

U.S. PATENT DOCUMENTS

| | | | |
|---|---|---|---|
| 4,393,272 | 7/1983 | Itakura et al. | 395/2.67 |
| 4,868,867 | 9/1989 | Davidson et al. | 395/2.75 |
| 5,265,167 | 11/1993 | Akamine et al. | 395/2.32 |
| 5,457,783 | 10/1995 | Chhatwal | 395/2.28 |
| 5,495,555 | 2/1996 | Swaminathan | 395/2.16 |

OTHER PUBLICATIONS

Paliwal et al, "Efficient Vector Quantization of LPC Parameters", IEEE Transactions on Speech and Audio Processing, vol. 1, No. 1, Jan. 1993, pp. 3–14.

Bruhn "Matrix Product Quantization For Very–Low–Rate Speech Coding", Proceedings ICASSP–95, May 1995, pp. 724–727.

Tsao, "Matrix Quantizer Design for LPC Speech Using the Generalized Lloyd Algorithm", IEEE Transactions on Acoustics, Speech, and Signal Rpocessing, vol. ASSP–33, No. 3, Jun. 1985, pp. 537–545.

ICASSP 84, Proceedings Mar. 19–21, 1984, San Diego, California, vol. 1of 3, IEEE International Conference on Acoustics, Speech, and Signal Processing, "Line Spectrum Pair (LSP) and Speech Data Compression" Soong et al, pp. 1.10.1–1.10.4.

"Effficient Coding of LSP Parameters Using Split Matrix Quantisation", Poc. ICASSP–95, pp. 740–743, Xydeas et al., May 1995.

*Primary Examiner*—Richemond Dorvil

*Attorney, Agent, or Firm*—Nixon & Vanderhye P.C.

[57] ABSTRACT

A speech synthesis system in which coefficients of a speech synthesis filter are quantized. An LSP or other filter coefficient representation which evolves slowly with time is generated for each of a series of N input speech frames to produce p coefficients in respect of each frame. The coefficients related to the N frames define a p×N matrix, with each row of the matrix containing N coefficients and each coefficient of one row being related to a respective one of the N frames. The matrix is split into a series of submatrices each made up from one or more of the rows, and each submatrix is vector quantized independently of the other submatrices using a composite time/spectral weighting function which for example emphasises distortion associated with high energy regions of the spectrum of each of the N input speech frames and is also proportional to the energy and degree of voicing of each of the N input speech frames. A codebook index is produced which is transmitted and used at the receiver to address a receiver codebook.

12 Claims, 3 Drawing Sheets

SPLIT MATRIX QUANTIZATION

BACKGROUND OF THE INVENTION

1. Field of the Invention

The present invention relates to a speech synthesis quantization system.

2. Related Art

Speech coding systems have a wide range of potential applications, including telephony, mobile radio and speech storage. The primary objective of speech coding is to enable speech to be represented in digital form such that intelligible speech of acceptable quality can be generated from the representation, but it is very important to minimise the number of bits required by the representation so as to maximise system capacity.

In an efficient digital speech communication system, an input acoustic signal is converted to an electrical signal, and the electrical signal is converted into computed sequences of numeric measurements which effectively define the parameters of an "excitation source—vocal tract" speech synthesis model. Parameters which define the vocal tract part of the model determine an "envelope" component of the speech short-term magnitude spectrum, which in turn can be estimated using the Discrete Fourier Transform (DFT) or using Linear Predictive Coding (LPC) techniques. The vocal tract parameters of the system are extracted periodically from successive speech frames, the parameters are quantized, and the quantized parameters are transmitted, together with excitation source parameters, to a receiver for the subsequent reconstruction (synthesis) of the required speech signal. The present invention is concerned with the efficient quantization of vocal tract parameters.

There is a requirement for high speech quality coding systems which are capable of operating in the region of for example 1.2 to 3.2 kbits/sec. In this context of low bit rate coding, the efficient quantization of coefficients is important in order to maximise the number of bits which can be allocated to other components of the transmitted signals.

Scalar quantization of LPC filter coefficients typically requires 38 to 40 bits per analysis frame if the quantization process is to be "transparent", which term refers to the case where, despite noise being introduced by quantizing the LPC coefficients, no audible distortion can be detected in the output speech signal. It is known to exploit interframe correlation using differential coding and frequency delayed coding techniques to reduce the bit requirements to about 30 bits per frame. Still lower bit rates can be achieved using known vector quantization (VQ) techniques. Split-VQ or single stage VQ offer acceptable performance with realistic storage and codebook search characteristics at 24 and 20 bits per frame respectively. Further compression can be obtained in principle by exploiting interframe correlation between sets of LPC coefficients. Adaptive codebook VQ systems have been proposed and combined in certain cases with differential coding and fixed codebooks, and switched adaptive interframe vector prediction can be employed which offers high LPC coefficient quantization performance at 19 to 21 bits per frame.

Whereas the above schemes attempt to reduce interframe correlation in a backwards manner using past information, it is known to use matrix quantization to allow the introduction of delay into the process and simultaneous operation on sets of filter coefficients obtained from successive frames using VQ principals. Matrix quantization has been applied to coding systems operating at or below 800 bits per second where "transparency" in LPC parameter quantization is not required. Excessive codebook storage and search requirements have been identified however as being associated with this technique. High complexity and large storage requirements are also a factor in systems which optimally combine a variable bit rate (segmentation) operation and matrix quantization. This method offers reasonable filter coefficient quantization performance at about 200 bits per second, but although this approach in theory performs better than matrix quantization, matrix quantization continues to be of interest because it results in a fixed bit rate system.

Details of the known vector quantization systems referred to above can be derived from the paper: "Efficient coding of LSP parameters using split matrix quantisation by C. S. Xydeas and C. Papanastasiou, Proc. ICASSP-95, pp. 740–743, 1995.

SUMMARY OF THE INVENTION

It is an object of the present invention to provide an improved quantization system in which the complexity and storage requirements associated with known matrix quantization systems can be overcome.

According to the present invention there is provided a speech synthesis system in which coefficients of a speech synthesis filter are quantized, wherein a slowly evolving with time filter representation of p coefficients is generated for each of a series of N input speech frames to define a p by N matrix, with each row of the matrix containing N coefficients and each coefficient of one row being related to a respective one of the N frames, the matrix is split into a series of submatrices each made up from one or more of the said rows, and each sub-matrix is vector quantized independently of the other sub-matrices, using a weighting function, to produce a codebook index which is transmitted and used at the receiver to address a receiver codebook.

The weighting function may be a composite time/spectral function selected for example to emphasise i) distortion associated with high energy regions of the spectrum of each of the N input speech frames and ii) distortion in high energy voiced frames. The representation may be a line spectrum pair (LSP) filter coefficient representation. LSP is widely used in speech coding. Relevant background information can be obtained from the paper "Line spectrum pair (LSP) and speech data compression" by Frank K. Soong and Biing-Hwang Juang, Proceedings of IEEE International Conference on Acoustics, Speech and Signal Processing, San Diego, Mar. 19–21, 1984, and from references listed in that paper. The weighting function may be proportional to the value of the short term power spectrum measured at each frequency associated with the LSP elements of the submatrices.

A further weighting function may be applied to all the filter coefficients of the N input speech frames, the further weighting function being proportional to the energy and the degree of voicing of that frame.

First, second and third codebooks may be provided, the first codebook being selected when all N frames are voiced, the second codebook being selected when all N frames are unvoiced, and the third codebook being selected when the N frames include both voiced and unvoiced frames.

BRIEF DESCRIPTION OF THE DRAWINGS

An embodiment of the present invention will now be described, by way of example, with reference to the accompanying drawings, in which.

DETAILED DESCRIPTION OF EXEMPLARY EMBODIMENTS

The invention proposes splitting a matrix representing a series of speech frames into sub-matrices which are then quantized independently with a view to overcoming the inherent drawbacks of known matrix quantization schemes, that is the drawbacks of high complexity and large storage requirements. In this context, four separate issues are discussed below;

I. Representations of the matrix elements as derived from LSP coefficients;

II. Distortion measures and associated time/spectral domain weighting functions used in codebook design and quantization processors;

III. Objective performance evaluation metrics which correlate well with subjective experiments performed using synthesised speech; and IV. Complexity and codebook storage characteristics.

Figure 3:
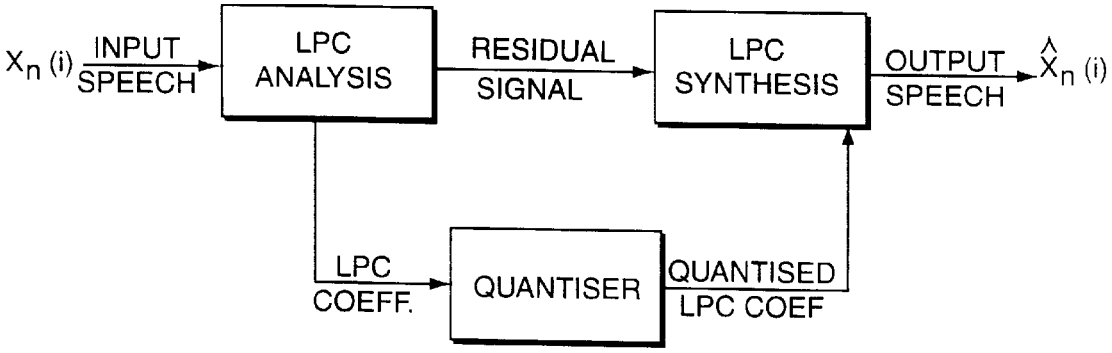
FIG. 3 is a schematic illustration of a subjective valuation system.
Figure 3A:
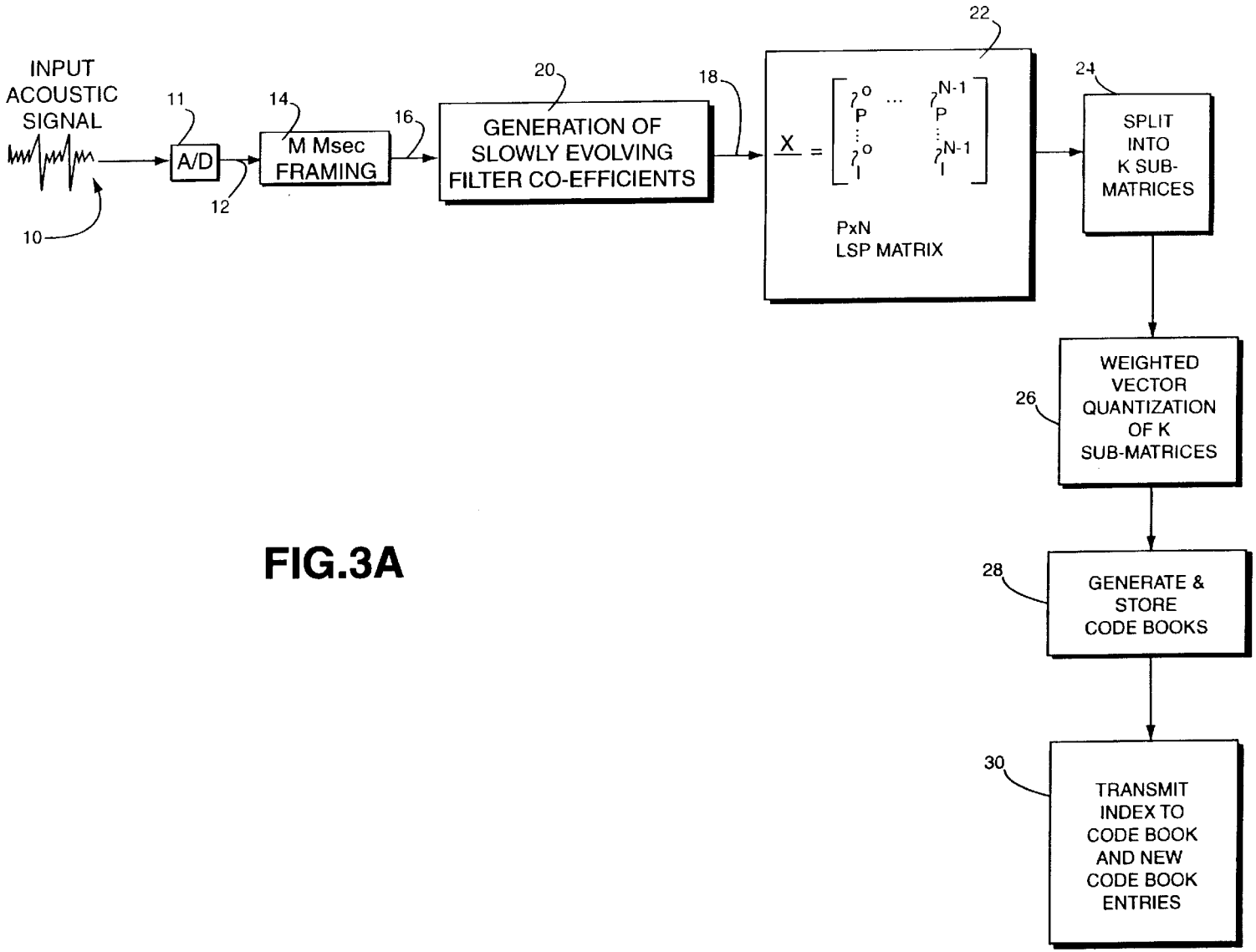
FIG. 3A is a more detailed "block diagram of the exemplary LPC analyzer and quantizer subsystems shown in FIG. 3.

FIG. 3A depicts an exemplary LPC analyzer and quantizer subsystem for the speech synthesis system shown in FIG. 3. As those in the art will appreciate, the depicted signal processing for such a system typically is carried out by a suitably programmed digital signal processor or other suitable digital signal processing hardware/firmware/software.

The starting point for split matrix quantization is a digital electrical signal 12 (output from A/D converter 11) representing an input acoustic signal 10. The digital signal is divided at 14 into a series of speech frames 16 each of M msec duration. A slowly evolving with time filter coefficient representation 18 must then be produced, for example an LSP representation. LSP coefficients could be derived directly by analysis of the speech signal, or alternatively as described below a conventional LPC analysis may be applied to each of the series of speech frames at 20 to yield a series of coefficient vectors:

$$a(n)=[a1^n, a2^n, a3^n, \ldots ap^n]$$

where p is the order of the LPC filter and n is the current frame. The LPC coefficients may be generated in a number of ways, for example using the Autocorrelation, Covariance or Lattice methods. Such methods are well known and are described in standard textbooks. The nth frame LPC coefficient vector a(n) is then transformed to an LSP representation:

$$\underline{l}(n)=[l1^n, l2^n, l3^n, \ldots, lp^n]$$

This transformation process at 22 is performed over N consecutive speech frames to provide an p×N LSP matrix;

$$\underline{X}=\begin{bmatrix} l_p^0 & l_p^1 & l_p^2 & \ldots & l_p^{N-1} \\ . & . & . & \ldots & . \\ . & . & . & \ldots & . \\ . & . & . & \ldots & . \\ l_3^0 & l_3^1 & l_3^2 & \ldots & l_3^{N-1} \\ l_2^0 & l_2^1 & l_2^2 & \ldots & l_2^{N-1} \\ l_1^0 & l_1^1 & l_1^2 & \ldots & l_1^{N-1} \end{bmatrix} \quad (1)$$

The above matrix can be split up at 24 into K submatrices:

$$\underline{L}_k=\begin{bmatrix} l^0_{S(k)-1} & l^1_{S(k)-1} & \cdots & l^{N-1}_{S(k)-1} \\ . & . & \ldots & . \\ l^0_{S(k-1)} & l^1_{S(k-1)} & \cdots & l^{N-1}_{S(k-1)} \end{bmatrix} \quad k=1,\ldots K \quad (2)$$

Note that: $S(k)=\sum_{j=o}^{k} m(j), m(0)=1, \sum_{k=1}^{K} m(k)=p$ and $$\underline{X}=[\underline{L}_k, \underline{L}_{k-1}, \ldots \underline{L}_1]^T$$

Each row (or set of m(k) rows) in X corresponds to a "trajectory" in time of spectral coefficients over N successive frames, and these trajectories can be vector quantized independently at 26. These trajectories form the basis for codebooks at 28 provided at both the transmitter and receiver, the codebooks being identical and storing a series of trajectories each of which is associated with a codeword index. Having selected a trajectory from the transmitter codebook, the associated codebook index is transmitted at 3 D to the receiver and used at the receiver to retrieve the appropriate trajectory from the receiver codebook. In designing the corresponding k=1,2 . . . K trajectory codebooks, sequences of $\{L_k\}$ are obtained by sliding a N-frame window, one frame at a time, along the entire training sequence of LPC speech frames. This sliding block technique maximises the number of vectors employed in the codebook design process and ensures that all phoneme transitions present in the input training sequences are captured. Furthermore, in order to maximise efficiency, different codebook training sequences are generated and hence different codebooks are designed for each of the following three cases a) All N LPC frames are voiced, b) all N LPC frames are unvoiced and c) the N LPC frames segment includes both voiced and unvoiced frames.

In order to exploit interframe correlation, the p×N matrix elements should reflect the characteristics of the speech short-term magnitude spectral envelope which change slowly with time. Thus it is possible to employ a formant-bandwidth LSP based representation. Using statistical observations LSPs may be related to formants and bandwidths by means of a centre frequency (i.e. the mean frequency of an LPC pair) and an offset frequency (i.e. half the difference frequency of an LSP pair). However, formant/bandwidth information will not always provide smooth trajectories over time and can be therefore difficult to quantize within the split matrix quantization framework. On the other hand, LSPs offer an efficient LPC representation due to their monotonicity property and their relatively smooth evolution over time.

Figure 1:
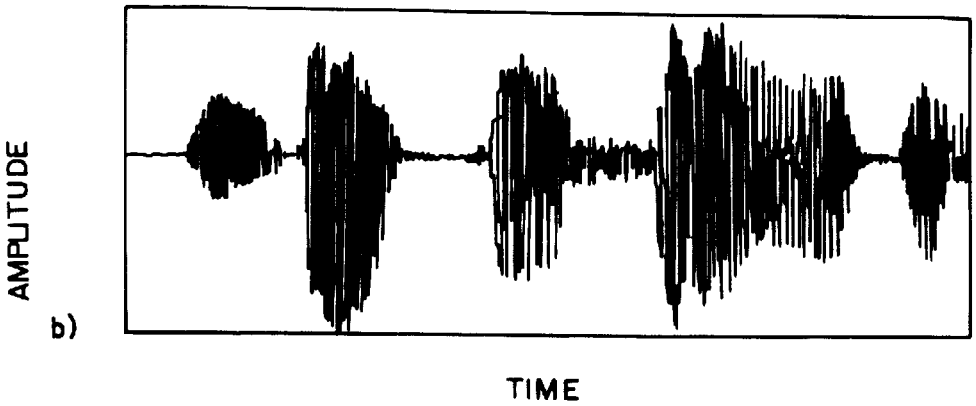
FIG. 1 is a representative speech waveform.
Figure 2:
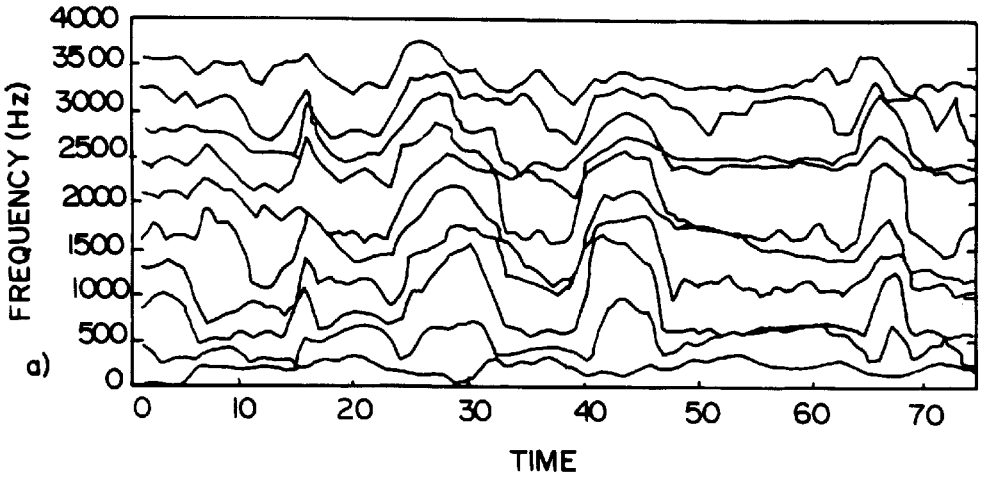
FIG. 2 illustrates LSP trajectories corresponding to the speech waveform of FIG. 1.

FIG. 1 shows a representative speech waveform in terms of amplitude versus time, and FIG. 2 shows the corresponding LSP trajectories. The time axis in both FIG. 1 and FIG. 2 is in terms of units of 20 msec each, each unit corresponding to one frame. Thus these figures represent waveforms over a period of 1.5 secs. The "smooth" LSP trajectories obtained during voiced speech are apparent. Both direct LSP and mean-difference LSP representations may be employed, but it is believed that superior results can be achieved with schemes based directly on LSP parameters.

Direct LSP based codebook design and search processes which have been put into effect have relied upon a weighted Euclidean distortion measure. This is defined as:

$$D(\underline{L}_k, L'_k) = \sum_{s=0}^{m(k)-1} \left[ \sum_{t=0}^{N-1} (LSP'_{S(k-1)+s} - LSP'_{S(k-1)+s})^2 w_s(s,t)^2 w_t(t)^2 \right] \quad (3)$$

where $\underline{L}'_k$ represents the kth quantized submatrix and $LSP''_{S(k-1)+s}$ are its elements.

The above equation includes a weighting factor $w_t(t)$ which is proportional to the energy and the degree of voicing in each LPC speech frame and is assigned to all the LSP spectral parameters of that frame. The weighting factor $W_t(t)$ is defined as follows:

$$w_t(t) = \left[ (A - Er(t)) \times \frac{En(t)}{Aver(En)} \right]^{\alpha} \times En(t)^{\alpha 1} \quad 0 \leqq t \leqq N-1$$

when the N LPC frames consist of both voiced and unvoiced frames $$w_t(t) = En(t)^{\alpha 1}$$

otherwise where Er(t) is the normalised energy of the prediction error of frame t, En(t) is the RMS value of speech frame t and Aver(En) is the average RMS value of the N LPC frames. The values of the constants $\alpha$ and $\alpha 1$ are set to 0.2 and 0.15 respectively.

A further weighting factor $W_s(s,t)$ is also used which is proportional to the value of the short term power spectrum measured at each frequency associated with the LSP element of the m(k)×N $\underline{L}_k$ submatrix. The weighting factor $W_s(s,t)$ is defined as follows:

$$w_s(s,t) = |P(LSP'_{S(k-1)+s})|^{\beta}$$

where $P(LSP'_{S(k-1)+s})$ is the value of the power envelope spectrum of the speech frame t at the $LSP'_{S(k-1)+s}$ frequency. $\beta$ is equal to 0.15.

The weighting factor $w_s(s,t)$ ensures that distortion associated with high energy spectral regions is emphasised, as compared to low energy spectral regions. In a similar way, the weighting factor $w_t(t)$ ensures that distortion associated with voiced frames is emphasised and thus quantization accuracy increases in the case of voiced speech segments.

The performance of an LPC/LSP quantization process can be measured in terms of subjective tests and/or objective distortion related measures. Subjective tests are often performed using an arrangement as represented in FIG. 3. Here, the actual residual signal is used to excite the corresponding LPC filter whose coefficients are quantized. The term "transparent" LPC quantization refers to the case where, as a result of the noise introduced by quantizing the LPC coefficients, no audible distortion can be detected on the $\hat{x}_n(i)$ output signal. Traditionally, objective measures that are used to assess the performance of quantization schemes operating on LPC parameters, are Spectral Distortion Measure (SDM) variants. SDM is defined as the root mean square difference formed between the original log-power LPC spectrum and the corresponding quantized log-power LPC spectrum. However, these SDM based measures focus on the accuracy of the quantization process to represent individual LPC frames, and thus fail to capture the perceptually important smooth evolution of LSP parameters across frames. The latter is exploited by split matrix quantization in accordance with the invention and as a consequence SDM measures do not relate well to subjective tests of the present invention.

A more accurate measure may be achieved by employing a time domain Segmental SNR metric, that is formed using the original $X_n(i)$ and synthesised $\hat{X}_n(i)$ signals (see FIG. 3). However, the $X_n(i)$ and $\hat{X}_n(i)$ signals are logarithmically ($\mu$-law) processed. This effectively provides a 3.5 dB amplification of high frequency spectral components. Furthermore, a weighting factor Weig(n) is also used in the Logarithmic Segmental SNR (LogSegSNR) averaging process, which increases the "contribution" of voiced speech frames:

$$Weig_t(n) = [En(n)^{0.1} \cdot C] \quad (4)$$

where En(n) is the energy of the nth frame and C=1 for a voiced frame or C=0.01 in the case of an unvoiced frame.

Extensive objective/subjective tests that have been conducted highlighted clearly the perceptual relevance of the LogSegSNR metric. However, it is advantageous to combine both the LogSegSNR and average SDM measures to establish accurate objective performance rules for "transparent" and "high quality" quantization of LPC parameters. The term "high quality" LPC quantization is used to indicated that, although a small difference can be perceived between the input and synthesised signals, nevertheless the effect of LPC quantization on the subjective quality of the output signal is negligible. In this context, "transparent" LPC quantization may be considered to be achieved when LogSegSNR>10 dB and AverSDM measured (using the weighting factor $Weig_t(n)$) in the frequency range of 2.4 to 3.4 Khz is below 1.75 dB. The corresponding values for "high quality" LPC quantization are 10 dB≧LogSegSNR≧9.5 dB and 2 dB≧AverSDM≧1.75 dB.

The proposed split matrix quantization (SMQ) scheme described above has been simulated for different values of K (the number of submatrices in the system), m(k) (the number of rows in the kth submatrix) and N (the number of columns in the matrix, that is the number of successive LPC frames used to form the matrix). Corresponding codebooks have been designed using, for training, 150 min duration of multi-speaker, multi-language speech material. In addition, several minutes of "out of training" speech from two male and two female speakers was used to evaluate the performance of various SMQ configurations, and a conventional 3-way {3,3,4} Split-VQ scheme has been employed as a benchmark in these experiments. In all cases the number p of LSP's in a frame was 10. The simulations included examples for K=10 and K=5. In the latter case each submatrix had two rows, i.e. m(k)=2 for k=1, 2 . . . 5. These two cases are referred to below as "single track" (m(k)=1, k=1, 2 . . . 10) and "double track" (m(k)=2, k=1, 2 . . . 5). Results obtained are represented in FIGS. 4, 5 and 6.

The inability of SDM to adequately reflect subjective performance was apparent from the fact that a 3-way Split-VQ scheme operating at 22 bits/frame provided the same AverSDM value of 1.67 dB with that obtained from a 18 bits/frame Single Track (K=10, N=4) SMQ quantizer (ST-SMQ, N=4). Subjectively however, ST-SMQ, N=4 produced considerably better speech quality.

Figure 4:
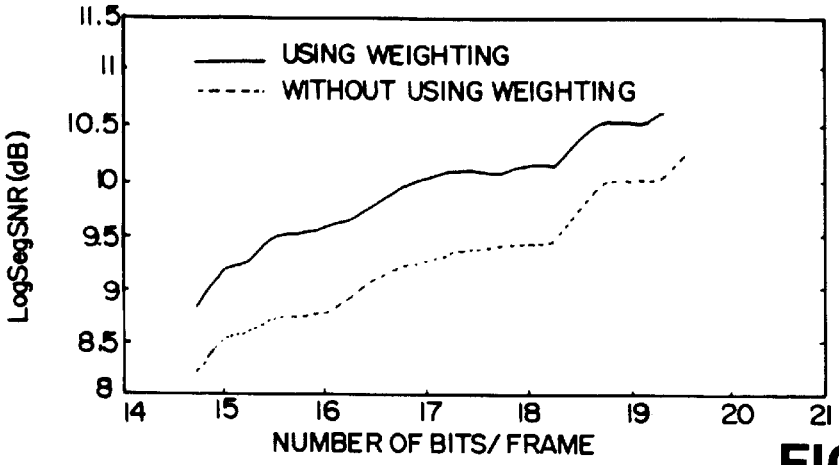
FIG. 4 illustrates the variation with bits per frame of a parameter used to evaluate the performance of the quantization process.

The crucial role of the weighting functions used in Equation 3 is highlighted in FIG. 4, where LogSegSMR values are plotted using different numbers of bits/frame for ST-SMQ, N=4 with or without weighting in the distortion measure. The 0.65 dB difference in the two curves corresponds to a net gain of 2 bits/frame.

Figure 5:
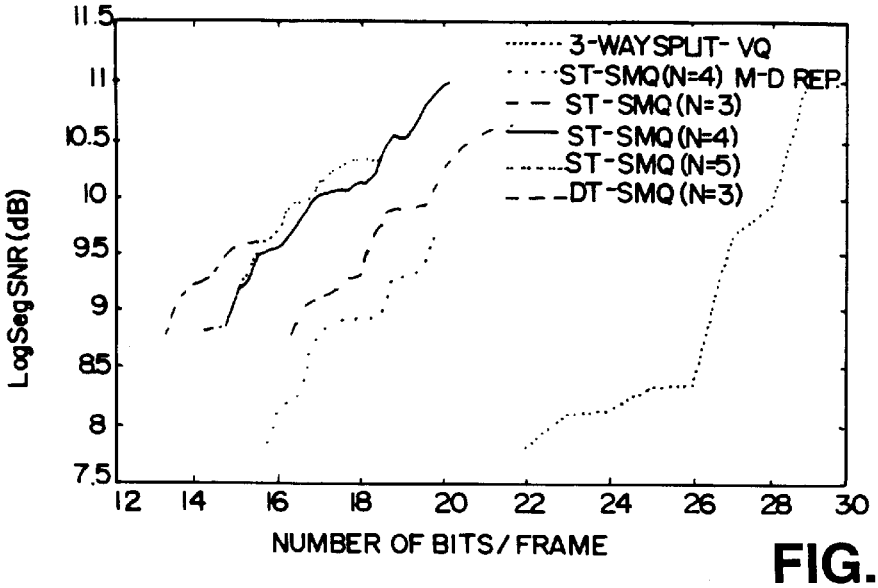
FIG. 5 plots relationships similar to those of FIG. 4 but with a variety of codebook configurations.
Figure 6:
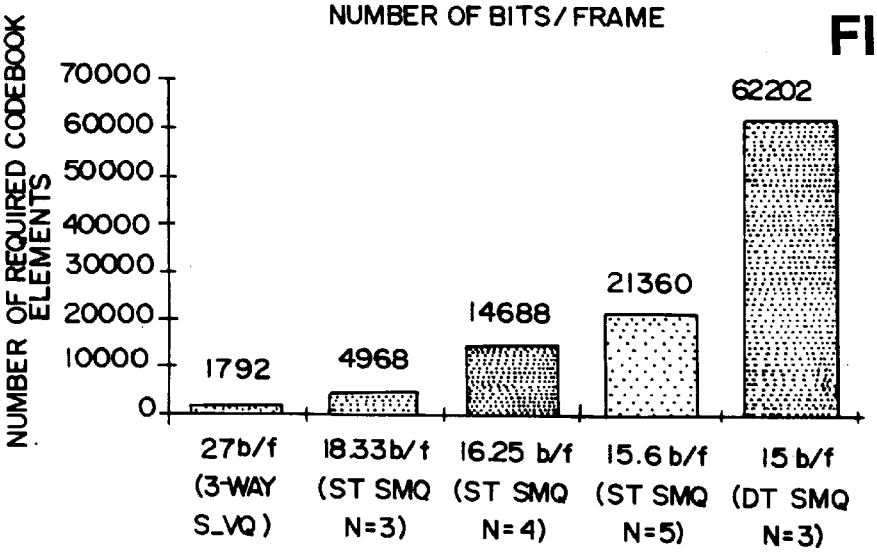
FIG. 6 schematically represents storage requirements for different high quality LPC quantization schemes.

FIG. 5 illustrates the LogSegSNR performance of several systems, as a function of bits/frame. An increase of N from 3 to 4 provides a 2 bits/frame advantage whereas a further increase to N=5 provides a smaller gain of 0.5 bits/frame. Thus with N=4 and a basic LPC frame of 20 msec duration, the system operates effectively at a rate of 12.5 segments/sec. This is comparable to the average phoneme rate and seems to be the segment length that exploits most of the existing interframe LPC correlation. Results are also included in FIG. 5 for Double Track SMQ (DT-SMQ) systems. These offer improved performance, as compared to ST-SMQ schemes. ST-SMQ quantizers can deliver an advantage of 12 bits/frame as compared to conventional Split-VQ.

Tables 1*a* to 1*f* below set out the bit allocations used to produce the results shown in FIG. 5:

TABLE 1a

Bit allocation for 3 way split VQ.

| bits per 20 ms | Number of bits per Group $G_1 = \{LSP_1, LSP_2, LSP_3\}$ | $G_2 = \{LSP_4, LSP_5, LSP_6\}$ | $G_3 = \{LSP_7, LSP_8, LSP_9, LSP_{10}\}$ |
|---|---|---|---|
| 30 | 10 | 10 | 10 |
| 29 | 9 | 10 | 10 |
| 28 | 8 | 10 | 10 |
| 27 | 8 | 9 | 10 |
| 26 | 7 | 9 | 10 |
| 25 | 7 | 9 | 9 |
| 24 | 7 | 8 | 9 |
| 23 | 7 | 8 | 8 |
| 22 | 7 | 7 | 8 |

TABLE 1b

Bit allocation for ST-SMQ with N = 4, using Direct LSP representation.

| bits per | Number of bits per Submatrix | | | | | | | | | |
|---|---|---|---|---|---|---|---|---|---|---|
| 20 ms | $L_1$ | $L_2$ | $L_3$ | $L_4$ | $L_5$ | $L_6$ | $L_7$ | $L_8$ | $L_9$ | $L_{10}$ |
| 20.50 | 9 | 9 | 9 | 9 | 9 | 9 | 8 | 8 | 6 | 6 |
| 20.25 | 9 | 9 | 9 | 9 | 9 | 9 | 8 | 8 | 6 | 5 |
| 20.00 | 9 | 9 | 9 | 9 | 9 | 8 | 8 | 8 | 6 | 5 |
| 19.75 | 9 | 9 | 9 | 9 | 8 | 8 | 8 | 8 | 6 | 5 |
| 19.50 | 9 | 9 | 9 | 8 | 8 | 8 | 8 | 8 | 6 | 5 |
| 19.25 | 9 | 9 | 8 | 8 | 8 | 8 | 8 | 8 | 6 | 5 |
| 19.00 | 9 | 9 | 8 | 8 | 8 | 8 | 8 | 7 | 6 | 5 |
| 18.75 | 9 | 9 | 8 | 8 | 8 | 8 | 8 | 7 | 6 | 4 |
| 18.50 | 8 | 9 | 8 | 8 | 8 | 8 | 8 | 7 | 6 | 4 |
| 18.25 | 8 | 8 | 8 | 8 | 8 | 8 | 8 | 7 | 6 | 4 |
| 18.00 | 8 | 8 | 8 | 8 | 8 | 8 | 8 | 7 | 6 | 3 |
| 17.75 | 8 | 8 | 8 | 8 | 8 | 8 | 7 | 7 | 6 | 3 |
| 17.50 | 8 | 8 | 8 | 8 | 8 | 8 | 6 | 7 | 6 | 3 |
| 17.25 | 8 | 8 | 8 | 8 | 8 | 8 | 6 | 6 | 6 | 3 |
| 17.00 | 8 | 8 | 8 | 8 | 8 | 7 | 6 | 6 | 6 | 3 |
| 16.75 | 8 | 8 | 8 | 8 | 7 | 7 | 6 | 6 | 6 | 3 |
| 16.50 | 8 | 8 | 8 | 7 | 7 | 7 | 6 | 6 | 6 | 3 |
| 16.25 | 7 | 8 | 8 | 7 | 7 | 7 | 6 | 6 | 6 | 3 |
| 16.00 | 7 | 8 | 8 | 6 | 7 | 7 | 6 | 6 | 6 | 3 |
| 15.75 | 7 | 8 | 8 | 6 | 7 | 7 | 6 | 6 | 5 | 3 |
| 15.50 | 7 | 8 | 8 | 6 | 7 | 6 | 6 | 6 | 5 | 3 |
| 15.25 | 7 | 8 | 7 | 6 | 7 | 6 | 6 | 6 | 5 | 3 |
| 15.00 | 7 | 8 | 7 | 6 | 6 | 6 | 6 | 6 | 5 | 3 |
| 14.75 | 7 | 7 | 7 | 6 | 6 | 6 | 6 | 6 | 5 | 3 |

TABLE 1c

Bit allocation for ST-SMQ with N = 4, using Mean-Difference LSP representation.

| bits per | Number of bits per Submatrix | | | | | | | | | |
|---|---|---|---|---|---|---|---|---|---|---|
| 20 ms | $L_1$ | $L_2$ | $L_3$ | $L_4$ | $L_5$ | $L_6$ | $L_7$ | $L_8$ | $L_9$ | $L_{10}$ |
| 20.00 | 10 | 10 | 9 | 9 | 8 | 8 | 8 | 8 | 7 | 3 |
| 19.75 | 10 | 10 | 9 | 9 | 8 | 8 | 8 | 7 | 7 | 3 |
| 19.50 | 10 | 10 | 9 | 9 | 8 | 8 | 7 | 7 | 7 | 3 |
| 19.25 | 10 | 9 | 9 | 9 | 8 | 8 | 7 | 7 | 7 | 3 |
| 19.00 | 10 | 9 | 9 | 8 | 8 | 8 | 7 | 7 | 7 | 3 |
| 18.75 | 10 | 9 | 9 | 8 | 7 | 8 | 7 | 7 | 7 | 3 |
| 18.50 | 9 | 9 | 9 | 8 | 7 | 8 | 7 | 7 | 7 | 3 |
| 18.25 | 9 | 9 | 9 | 8 | 7 | 7 | 7 | 7 | 7 | 3 |
| 18.00 | 9 | 9 | 9 | 8 | 6 | 7 | 7 | 7 | 7 | 3 |
| 17.75 | 9 | 9 | 9 | 8 | 6 | 7 | 7 | 7 | 6 | 3 |
| 17.50 | 9 | 9 | 9 | 8 | 6 | 7 | 7 | 7 | 5 | 3 |
| 17.25 | 9 | 9 | 9 | 7 | 6 | 7 | 7 | 7 | 5 | 3 |
| 17.00 | 9 | 9 | 9 | 7 | 6 | 7 | 7 | 6 | 5 | 3 |
| 16.75 | 9 | 9 | 9 | 7 | 6 | 7 | 6 | 6 | 5 | 3 |
| 16.50 | 9 | 9 | 9 | 7 | 6 | 6 | 6 | 6 | 5 | 3 |
| 16.25 | 9 | 9 | 8 | 7 | 6 | 6 | 6 | 6 | 5 | 3 |
| 16.00 | 9 | 8 | 8 | 7 | 6 | 6 | 6 | 6 | 5 | 3 |
| 15.75 | 8 | 8 | 8 | 7 | 6 | 6 | 7 | 6 | 5 | 3 |

TABLE 1d

Bit allocation for ST-SMQ with N = 3, using Direct LSP representation.

| bits per | Number of bits per Submatrix | | | | | | | | | |
|---|---|---|---|---|---|---|---|---|---|---|
| 20 ms | $L_1$ | $L_2$ | $L_3$ | $L_4$ | $L_5$ | $L_6$ | $L_7$ | $L_8$ | $L_9$ | $L_{10}$ |
| 21.67 | 7 | 7 | 7 | 7 | 7 | 7 | 7 | 6 | 5 | 5 |
| 21.33 | 7 | 7 | 7 | 7 | 7 | 7 | 7 | 6 | 5 | 4 |
| 22.00 | 7 | 7 | 7 | 7 | 7 | 7 | 6 | 6 | 5 | 4 |
| 20.67 | 7 | 7 | 7 | 7 | 7 | 6 | 6 | 6 | 5 | 4 |
| 20.33 | 7 | 7 | 7 | 7 | 6 | 6 | 6 | 6 | 5 | 4 |
| 20.00 | 7 | 7 | 7 | 6 | 6 | 6 | 6 | 6 | 5 | 4 |
| 19.67 | 7 | 7 | 6 | 6 | 8 | 6 | 6 | 6 | 5 | 4 |
| 19.33 | 7 | 7 | 6 | 6 | 6 | 6 | 6 | 6 | 5 | 3 |
| 19.00 | 7 | 7 | 6 | 6 | 6 | 6 | 6 | 5 | 5 | 3 |
| 18.67 | 7 | 7 | 6 | 6 | 6 | 6 | 5 | 5 | 5 | 3 |
| 18.33 | 6 | 7 | 6 | 6 | 6 | 6 | 5 | 5 | 5 | 3 |
| 18.00 | 6 | 6 | 6 | 6 | 6 | 6 | 5 | 5 | 5 | 3 |
| 17.67 | 6 | 6 | 6 | 6 | 6 | 6 | 5 | 5 | 4 | 3 |
| 17.33 | 6 | 6 | 6 | 6 | 6 | 5 | 5 | 5 | 4 | 3 |
| 17.00 | 6 | 6 | 6 | 6 | 5 | 5 | 5 | 5 | 4 | 3 |
| 16.67 | 6 | 6 | 6 | 5 | 5 | 5 | 5 | 5 | 4 | 3 |
| 16.33 | 6 | 6 | 5 | 5 | 5 | 5 | 5 | 5 | 4 | 3 |

TABLE 1e

Bit allocation for ST-SMQ with N = 5, using Direct LSP representation.

| bits per | Number of bits per Submatrix | | | | | | | | | |
|---|---|---|---|---|---|---|---|---|---|---|
| 20 ms | $L_1$ | $L_2$ | $L_3$ | $L_4$ | $L_5$ | $L_6$ | $L_7$ | $L_8$ | $L_9$ | $L_{10}$ |
| 18.40 | 10 | 10 | 10 | 10 | 10 | 10 | 10 | 9 | 8 | 5 |
| 18.20 | 10 | 10 | 10 | 10 | 10 | 10 | 10 | 9 | 8 | 4 |
| 18.00 | 10 | 10 | 10 | 10 | 10 | 10 | 9 | 9 | 8 | 4 |
| 17.80 | 10 | 10 | 10 | 10 | 10 | 10 | 9 | 8 | 8 | 4 |
| 17.60 | 10 | 10 | 10 | 10 | 10 | 10 | 8 | 8 | 8 | 4 |
| 17.40 | 10 | 10 | 10 | 10 | 10 | 9 | 8 | 8 | 8 | 4 |
| 17.20 | 10 | 10 | 10 | 10 | 9 | 9 | 8 | 8 | 8 | 4 |
| 17.00 | 10 | 10 | 10 | 9 | 9 | 9 | 8 | 8 | 8 | 4 |
| 16.80 | 9 | 10 | 10 | 9 | 9 | 9 | 8 | 8 | 8 | 4 |
| 16.60 | 9 | 10 | 10 | 8 | 9 | 9 | 8 | 8 | 8 | 4 |
| 16.40 | 9 | 10 | 10 | 8 | 9 | 9 | 8 | 8 | 7 | 4 |
| 16.20 | 9 | 10 | 10 | 8 | 9 | 8 | 8 | 8 | 7 | 4 |
| 16.00 | 9 | 10 | 9 | 8 | 9 | 8 | 8 | 8 | 7 | 4 |
| 15.80 | 9 | 10 | 9 | 8 | 8 | 8 | 8 | 8 | 7 | 4 |

TABLE 1e-continued

Bit allocation for ST-SMQ with N = 5, using Direct LSP representation.

| bits per | Number of bits per Submatrix | | | | | | | | | |
|---|---|---|---|---|---|---|---|---|---|---|
| 20 ms | $L_1$ | $L_2$ | $L_3$ | $L_4$ | $L_5$ | $L_6$ | $L_7$ | $L_8$ | $L_9$ | $L_{10}$ |
| 15.60 | 9 | 9 | 9 | 8 | 8 | 8 | 8 | 8 | 7 | 4 |
| 15.40 | 9 | 9 | 9 | 8 | 8 | 8 | 8 | 8 | 6 | 4 |
| 15.20 | 9 | 9 | 8 | 8 | 8 | 8 | 8 | 8 | 6 | 4 |
| 15.00 | 8 | 9 | 8 | 8 | 8 | 8 | 8 | 8 | 6 | 4 |
| 14.80 | 8 | 8 | 8 | 8 | 8 | 8 | 8 | 8 | 6 | 4 |
| 14.60 | 8 | 8 | 8 | 8 | 8 | 8 | 8 | 7 | 6 | 4 |
| 14.40 | 8 | 8 | 8 | 8 | 8 | 8 | 7 | 7 | 6 | 4 |
| 14.20 | 8 | 8 | 8 | 8 | 8 | 7 | 7 | 7 | 6 | 4 |

TABLE 1f

Bit allocation for DT-SMQ with N = 3, using Direct LSP representation.

| bits per | Number of bits per Submatrix | | | | |
|---|---|---|---|---|---|
| 20 ms | $L_1$ | $L_2$ | $L_3$ | $L_4$ | $L_5$ |
| 15.67 | 10 | 10 | 10 | 9 | 8 |
| 15.33 | 10 | 10 | 10 | 8 | 8 |
| 15.00 | 10 | 10 | 10 | 8 | 7 |
| 14.67 | 10 | 10 | 9 | 8 | 7 |
| 14.33 | 10 | 10 | 8 | 8 | 7 |
| 14.00 | 10 | 9 | 8 | 8 | 7 |
| 13.67 | 10 | 9 | 8 | 8 | 6 |
| 13.33 | 9 | 9 | 8 | 8 | 6 |

FIG. 6 illustrates storage requirements in terms of the number of codebook elements required for different SMQ configurations.

Thus the present invention may be implemented in any one of a number of possible ways to achieve different performance/complexity characteristics.

I claim:

1. A speech synthesis system including means for quantizing coefficient signals of a speech synthesis filter, said means for quantizing comprising:

means for generating a slowly evolving with time filter representation of p coefficient signals for each of a series of N input speech frames to define a p by N matrix of coefficient signals, with each row of the matrix containing N coefficient signals and each coefficient signal of one row being related to a respective one of the N frames, means for splitting the matrix of signals into a series of submatrices of signals each made up from at least one of the said rows, and means for vector quantizing each sub-matrix of signals independently of the other sub-matrices, using a weighting function, to produce a codebook of index signals which are transmitted and used at the receiver to address a receiver codebook of signals.

2. A system as in claim 1, wherein the means for vector quantization includes means for generating the weighting function to emphasis distortion associated with high energy regions of the spectrum of each of the N input speech frames.

3. A system as in claim 2, wherein said means for generating the weighting function includes means for applying a further weighting function to all filter coefficients of each of the N input speech frames, the further weighting function being proportional to the energy and the degree of voicing of that frame.

4. A system as in claim 1, wherein the filter representation is an LSP (Line Spectrum Pair) filter coefficient representation.

5. A system as in claim 4, wherein the weighting function is proportional to the value of the short term power spectrum measured at each frequency associated with the LSP elements of the submatrices.

6. A system as in claim 1, wherein first, second and third codebooks are provided, the first codebook being selected when all N frames are voiced, the second codebook being selected when all N frames are unvoiced, and a third codebook being selected when the N frames include both voiced and unvoiced frames.

7. A method for quantizing coefficient signals of a speech synthesis filter, said method comprising:

generating a slowly evolving with time filter representation of p coefficient signals for each of a series of N input speech frames to define a p by N matrix of coefficient signals, with each row of the matrix containing N coefficient signals and each coefficient signal of one row being related to a respective one of the N frames, splitting the matrix of signals into a series of sub-matrices of signals each made up from at least one of the said rows, and vector quantizing each sub-matrix of signals independently of the other submatrices, using a weighting function, to produce a codebook of index signals which are transmitted and used at the receiver to address a receiver codebook of signals.

8. A method as in claim 7, wherein the vector quantization step includes generating the weighting function to emphasize distortion associated with high energy regions of the spectrum of each of the N input speech frames.

9. A method as in claim 8, wherein said generating step includes applying a further weighting function to all filter coefficients of each of the N input speech frames, the further weighting function being proportional to the energy and the degree of voicing of that frame.

10. A method as in claim 7, wherein the filter representation is an LSP (Line Spectrum Pair) filter coefficient representation.

11. A method as in claim 10, wherein the weighting function is proportional to the value of the short term power spectrum measured at each frequency associated with the LSP elements of the submatrices.

12. A method as in claim 7, wherein first, second and third codebooks are provided, the first codebook being selected when all N frames are voiced, the second codebook being selected when all N frames are unvoiced, and a third codebook being selected when the N frames include both voiced and unvoiced frames.

* * * * *